US006347464B1

(12) United States Patent
Klager

(10) Patent No.: US 6,347,464 B1
(45) Date of Patent: Feb. 19, 2002

(54) SELF-CLEANING HYDRAULIC CLAM BUCKET

(76) Inventor: Gene Klager, 306 Heather La., Conroe, TX (US) 77385

( * ) Notice: Subject to any disclaimer, the term of this patent is extended or adjusted under 35 U.S.C. 154(b) by 0 days.

(21) Appl. No.: 09/474,609

(22) Filed: Dec. 29, 1999

(51) Int. Cl.[7] ..... B66C 3/02

(52) U.S. Cl. ..... 37/187; 37/901; 294/68.23; 414/725; 414/726

(58) Field of Search ..... 37/461, 184, 185, 37/186, 187, 188, 901; 294/68.23; 414/723, 725

(56) References Cited

U.S. PATENT DOCUMENTS

| | | | | | |
|---|---|---|---|---|---|
| 2,715,787 | A | * | 8/1955 | Williams | 37/187 |
| 2,719,641 | A | * | 10/1955 | Pilch | 37/901 |
| 2,725,996 | A | * | 12/1955 | Britton | 37/187 |
| 2,755,946 | A | * | 7/1956 | Bevan | 37/187 |
| 3,380,604 | A | * | 4/1968 | Leese | 37/901 |
| 3,413,029 | A | * | 11/1968 | Donovan | 294/70 |
| 3,581,924 | A | * | 6/1971 | Marz | 214/767 |
| 3,881,263 | A | * | 5/1975 | Coeurderoy | 37/186 |
| 3,920,137 | A | | 11/1975 | McCain | 414/697 |
| 4,257,731 | A | | 3/1981 | Beaver | 414/694 |
| 4,326,571 | A | * | 4/1982 | Crawford | 144/34 E |
| 4,333,676 | A | * | 6/1982 | Thumm | 294/88 |
| 4,392,774 | A | | 7/1983 | Thomas, Jr. | 414/726 |
| 4,497,608 | A | * | 2/1985 | Sheppard et al. | 414/726 |
| 4,542,929 | A | * | 9/1985 | Possinger | 294/88 |
| 5,184,933 | A | * | 2/1993 | Pei-Qian et al. | 414/725 |
| 5,228,735 | A | | 7/1993 | Morrow, Sr. | 294/68.23 |
| 5,330,242 | A | * | 7/1994 | Luck, Sr. | 294/88 |
| 5,553,405 | A | * | 9/1996 | Hayashi et al. | 37/189 |
| 6,052,926 | A | * | 4/2000 | Stephens | 37/444 |

* cited by examiner

*Primary Examiner*—Victor Batson

(57) ABSTRACT

A clam bucket of a type designed to attach by way of a pin (20) through vertical lugs (92) to the stick of an excavator making the attachment process fairly simple. These vertical lugs (92) are part of the rotational housing (32) assembly which, in conjunction with a rotational mounting plate (22) at the top of a square tubing extension (48) enable the bucket (70) to make a full 360° turn. The bucket (70) halves are each powered by a hydraulic cylinder (56), the lines of which attach to excavator controls. The clean-out system is a pair of wiper plates (86) incorporated into the bucket (70) halves. These wiper plates (86) sweep the bucket (70) halves each time the bucket opens and closes preventing buildup of material. This self-cleaning hydraulic clam bucket can be manufactured in size to suit the consumer.

10 Claims, 6 Drawing Sheets

SELF-CLEANING HYDRAULIC CLAM BUCKET

CROSS-REFERENCE TO RELATED APPLICATIONS

Not Applicable.

BACKGROUND—FIELD OF INVENTION

This invention relates to the construction industry, specifically to the excavation of the material in confined areas.

BACKGROUND—DESCRIPTION OF PRIOR ART

Contractors from the beginning of mechanized excavation have looked for ways to excavate earth and material from confined areas and depending on material being excavated have looked for a bucket that would clean out with each scoop so that the excavation could proceed more efficiently.

The original clam buckets worked off of steam driven winches and wire rope cables. This design stayed basically the same until the 1960's with the advent of hydraulic excavators.

Inventors then began to develop buckets based on the use of hydraulic power. U.S. Pat. No. 4,392,774 to Thomas (1983) discloses an attempt to develop a clam bucket using a single cable run through sheaves. The operating mechanism extends beyond the radius of the bucket limiting the accessible area of the attachment and making the arm susceptible to hanging inside a shored excavation. U.S. Pat. No. 5,228,735 to Morrow (1991) shows a clam bucket assembly which incorporates an elaborate linkage system, costly to manufacture and maintain. The hydraulic tubes are exposed creating the possibility of breakage sending 180° fluid spraying into the atmosphere and/or on to workman. This unit gives no extended reach to work over objects. Also, it has no bucket cleaner. U.S. Pat. No. 4,257,731 to Beaver (1978) demonstrates a clam bucket that does not increase digging depth. The assembly requires extra hydraulics from the host machine and uses an elaborate linkage system to operate the bucket, thus raising the cost to the consumer. This design again has no bucket cleaner. U.S. Pat. No. 3,920,137 to McCain (1974) shows a clam bucket assembly designed with a very elaborate mechanism that is costly to manufacture and maintain and does not increase digging depth or reach and this patent claims no bucket cleaner.

The above referenced buckets suffer from a number of disadvantages:

(a) Expensive and elaborate linkage mechanism. Costly to build and maintain.

(b) All hydraulic requirements use an extra system which has to be added to the host mechanism at an added cost.

(c) None of the previously patented buckets give added reach to work on the far side of obstacles.

(d) None of the previously patented buckets have a self-cleaning bucket which allows the removal of wet and sticky material that becomes trapped in the bucket.

SUMMARY

In accordance with the present invention, a clam bucket comprised of a rotational plate, a square tube extension, two (2) hydraulic cylinders operated by standard hydraulic circuitry, and is self-cleaning.

OBJECTS AND ADVANTAGES

Accordingly, the objects and advantages of my self-cleaning hydraulic clam bucket are:

(a) an hydraulic clam bucket that requires no additional hydraulic circuitry to operate.

(b) extended digging depth.

(c) ability to dig over the top of obstacles and rotate to the needed position.

(d) self-cleaning bucket. The bucket cleans its internal dimension upon each opening cycle, thus removing all types of material which stick and are packed into the bucket upon closing.

(e) no elaborate mechanical linkage to maintain and wear out.

Further objects and advantages of my self-cleaning hydraulic clam bucket will become apparent from a consideration of the drawings and ensuing description.

DRAWING FIGURES.

REFERENCE NEMERALS IN DRAWINGS

| | | | |
|---|---|---|---|
| 10 | hydraulic clam bucket | 12 | rotational assembly |
| 14 | extension assembly | 16 | self-cleaning bucket |
| 20 | pin assembly | 22 | rotational mounting plate |
| 24 | threaded shaft | 26 | tapered roller bearing |
| 28 | seal plate | 30 | seal |
| 32 | rotational housing | 34 | radial bearing |
| 36 | mechanical housing | 38 | seal assembly |
| 40 | threaded nut | 42 | set screws |
| 44 | top plate | 46 | bolts |
| 48 | square tubing extension | 50 | plate assembly |
| 52 | extension pad eye | 54 | pin |
| 56 | hydraulic cylinder | 58 | cylinder pad eye |
| 60 | cylinder pin | 62 | bucket assembly pad eye |
| 64 | bucket cylinder pad eye | 68 | pin |
| 70 | bucket | 72 | stem |
| 74 | valve | 76 | valve manifold |
| 78 | oil port | 80 | hose assembly |
| 82 | tee manifold | 84 | magnetic clamp |
| 86 | wiper plate | 88 | hinge assembly |
| 90 | stop | 92 | vertical lug |
| 94 | stick assembly | 96 | excavator |
| 98 | excavator cylinder | | |

DESCRIPTION

Figure 1:
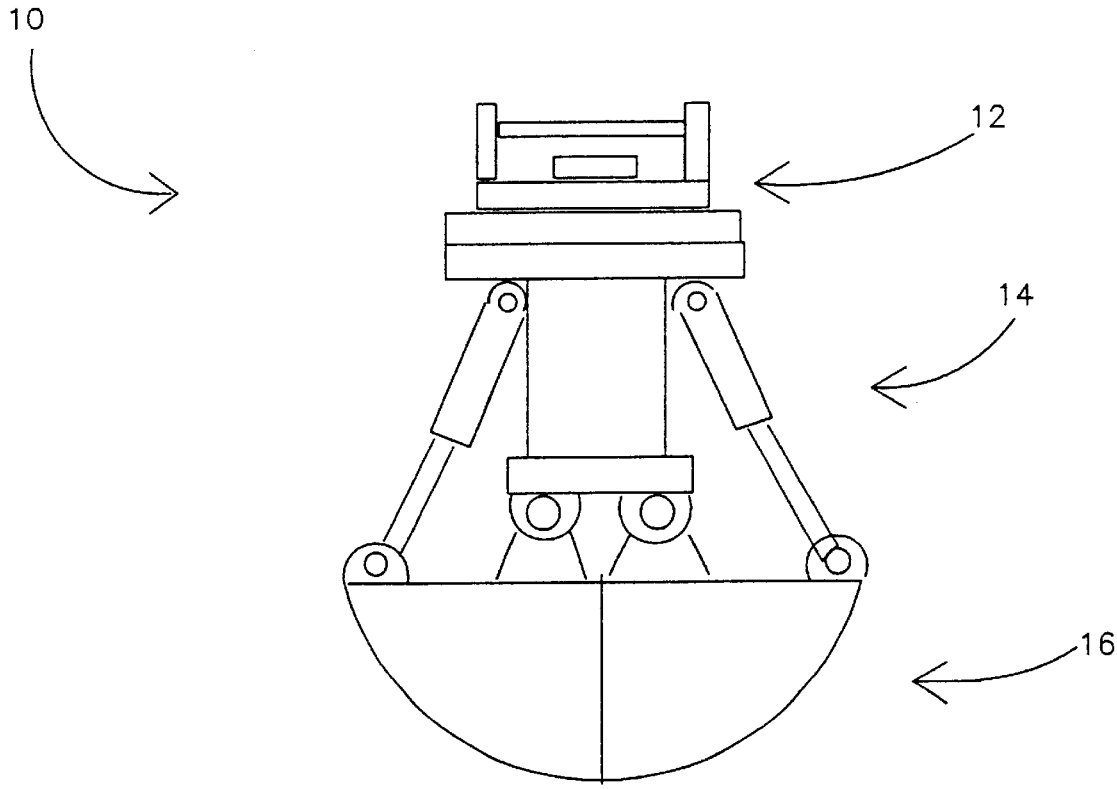
FIG. 1 shows a side view of the self-cleaning hydraulic clam bucket (10).

FIG. 1 shows a side view of the self-cleaning hydraulic clam bucket (10).

Figure 2:
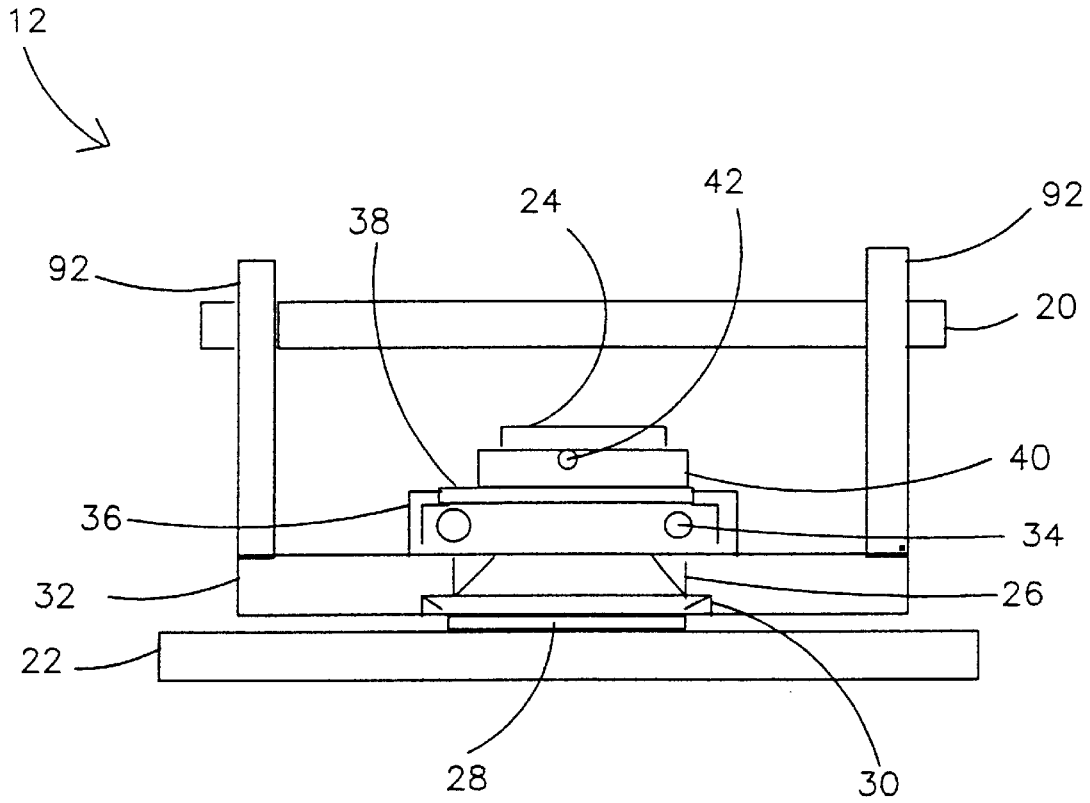
FIG. 2 shows a detailed view of the rotational assembly, the portion indicated by number (12) in FIG. 1.

FIG. 2 shows a view of the rotational mounting assembly (12).

Excavator pin (20) is inserted through bore in vertical lug (92), through stick assembly of excavator, through bore in opposite vertical lug (92), thus, linking the excavator and the clam bucket together allowing self-cleaning hydraulic clam bucket to hang vertical to stick assembly.

FIG. 2 consists of rotational mounting plate (22) which is drilled and tapped at strategic stress points.

A threaded shaft (24) threaded on one end and beveled on the other is fitted to rotational mounting plate (22) and welded to code attaching it to rotational mounting plate (22).

A ring seal ring plate (28) is fitted to threaded shaft (24). A tapered roller bearing (26) is fitted to the threaded shaft (24) above ring seal plate (28).

Rotational housing (32) is machined to accept a seal (30) and the race portion of tapered roller bearing (26). A recess is machined into the top of rotational housing (32). A mechanical housing (36) is welded around the recess in rotational housing (32) allowing a radial bearing (34) to be installed inside. The top of mechanical housing (36) is machined to hold seal assembly (38), sealing tapered roller bearing (26) from dirt and foreign material.

A threaded nut (40) is screwed on to threaded shaft (24), tightened to adjust bearing load and locked in place by set screws (42). Rotational mounting plate (22) will then rotate freely allowing the self-cleaning hydraulic clam bucket to rotate so as to position the bucket as desired.

Figure 3:
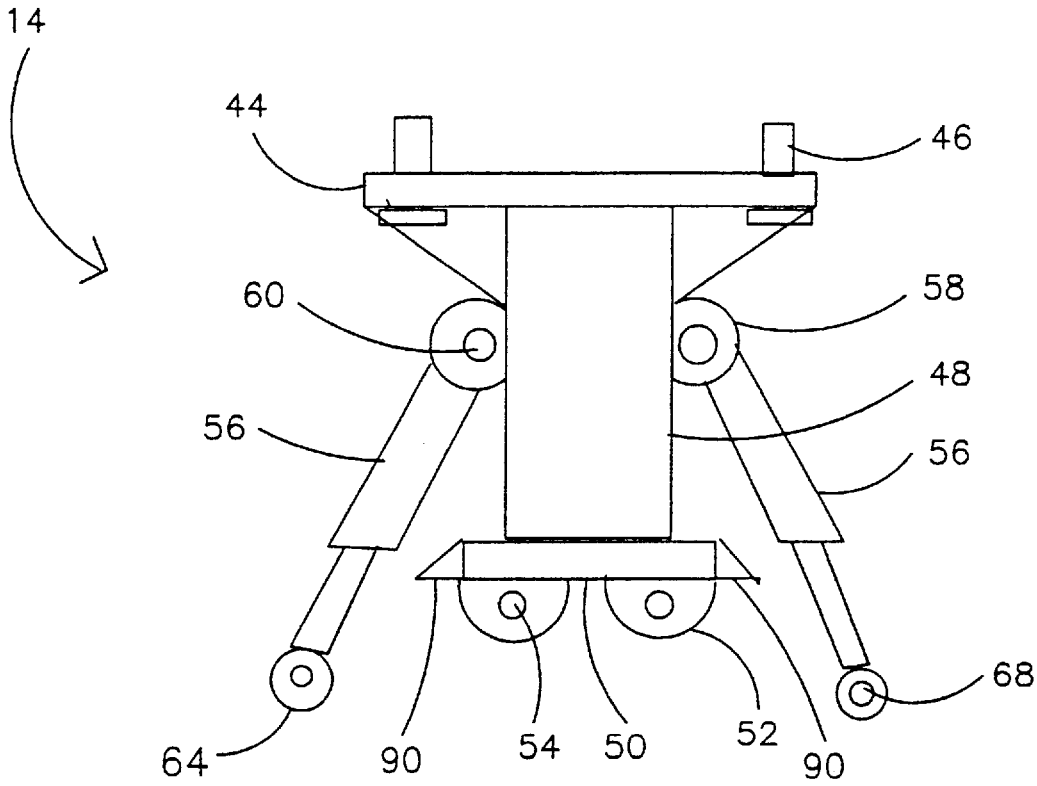
FIG. 3 shows a detailed view of the extension assembly, the portion indicated by number (14) in FIG. 1.

In FIG. 3 the top plate (44) is bolted (46) to the rotational mounting plate (22)in FIG. 2. A square tubing extension (48) is welded to top plate (44). A plate assembly (50) consists of eight [8] extension pad eyes (52) that are drilled to accept a pin (54). Extension pad eyes (52) are welded to plate assembly (50) at intervals to allow bucket assembly pad eyes (62) in FIG. 4 to fit between square tubing extension (48). A pin (54) holds the assembly together allowing ½ of each side of bucket (70) in FIG. 4 to swing freely on plate assembly (50).

There are two [2] hydraulic cylinders (56) attached to the top end of square tubing extension (48) via a cylinder pad eye (58) and a cylinder pin (60). The hydraulic cylinders (56) hang freely on square tubing extension (48).

The rod end of hydraulic cylinder (56) is attached to bucket (70) (not shown) via a bucket cylinder pad eye (64) and bucket cylinder pad eye pin (68) assembly.

Figure 4A:
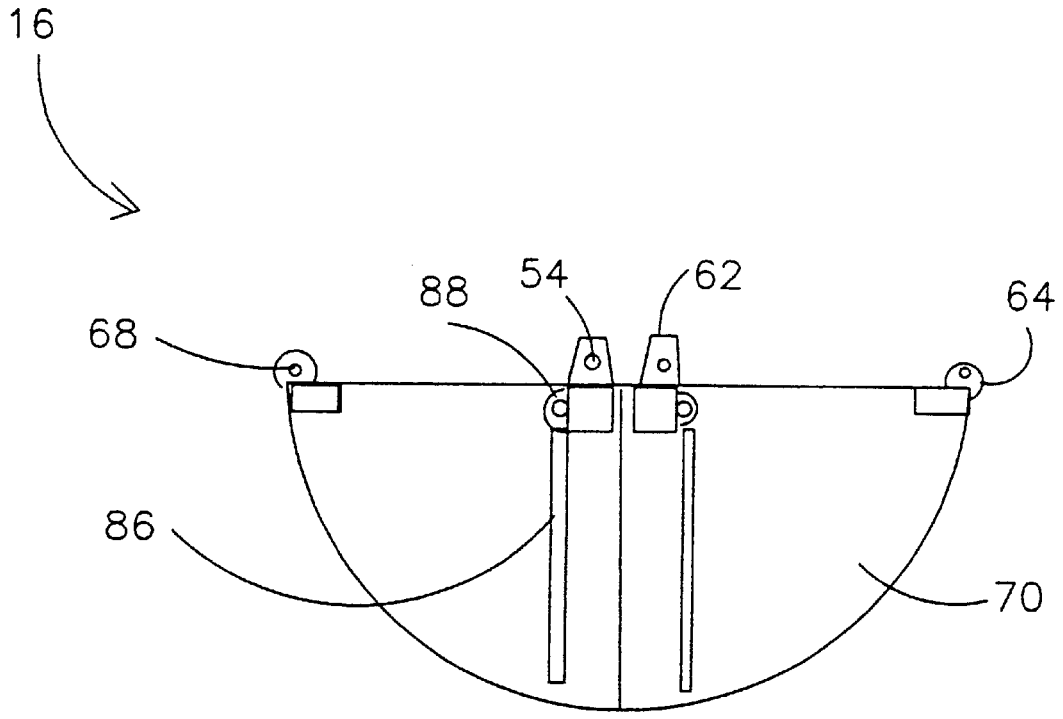
FIG. 4A shows a detailed view of the self-cleaning bucket portion indicated by number (16) in FIG. 1.
Figure 4B:
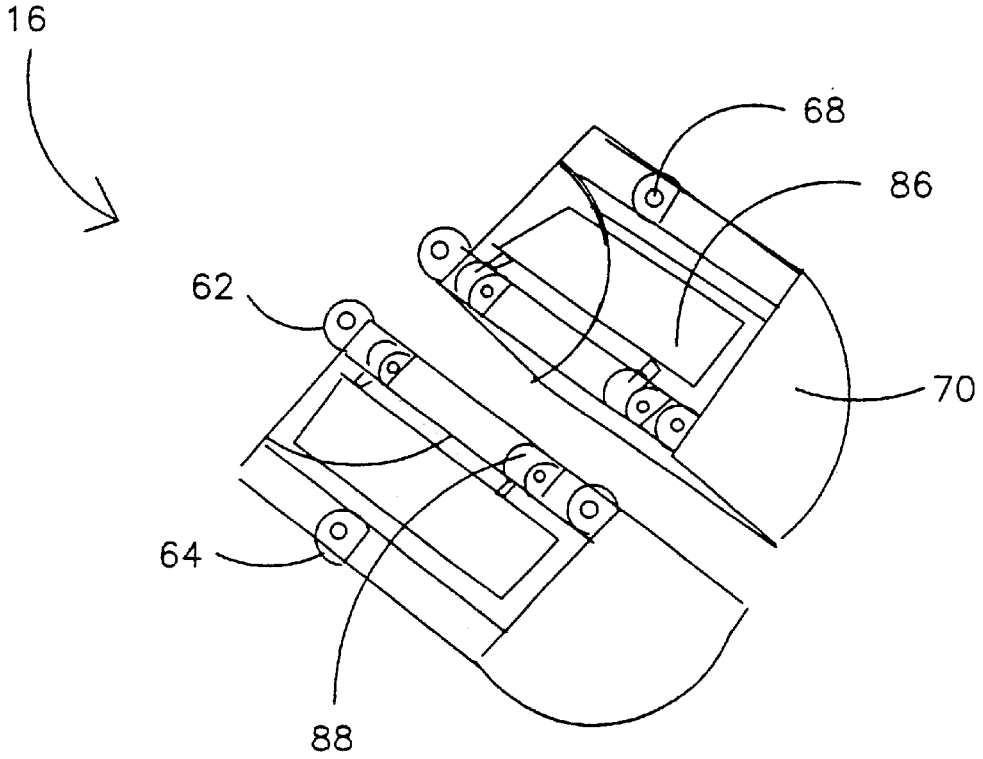
FIG. 4B shows a top perspective view of the bucket assembly portion indicated by number (16) in FIG. 1.

Each side of the bucket (70) shown in FIG. 4A and 4B has a wiper plate (86) that swings freely via a hinge assembly (88). The wiper plates move to the top of the bucket (70) by dirt being forced into the bucket (70). When the bucket (70) is full, the wiper plates (86) stop at the struck capacity. Upon opening, each wiper plate (86) strikes a stop (90), as shown in FIG. 3, forcing them downward and ejecting the dirt.

Figure 5:
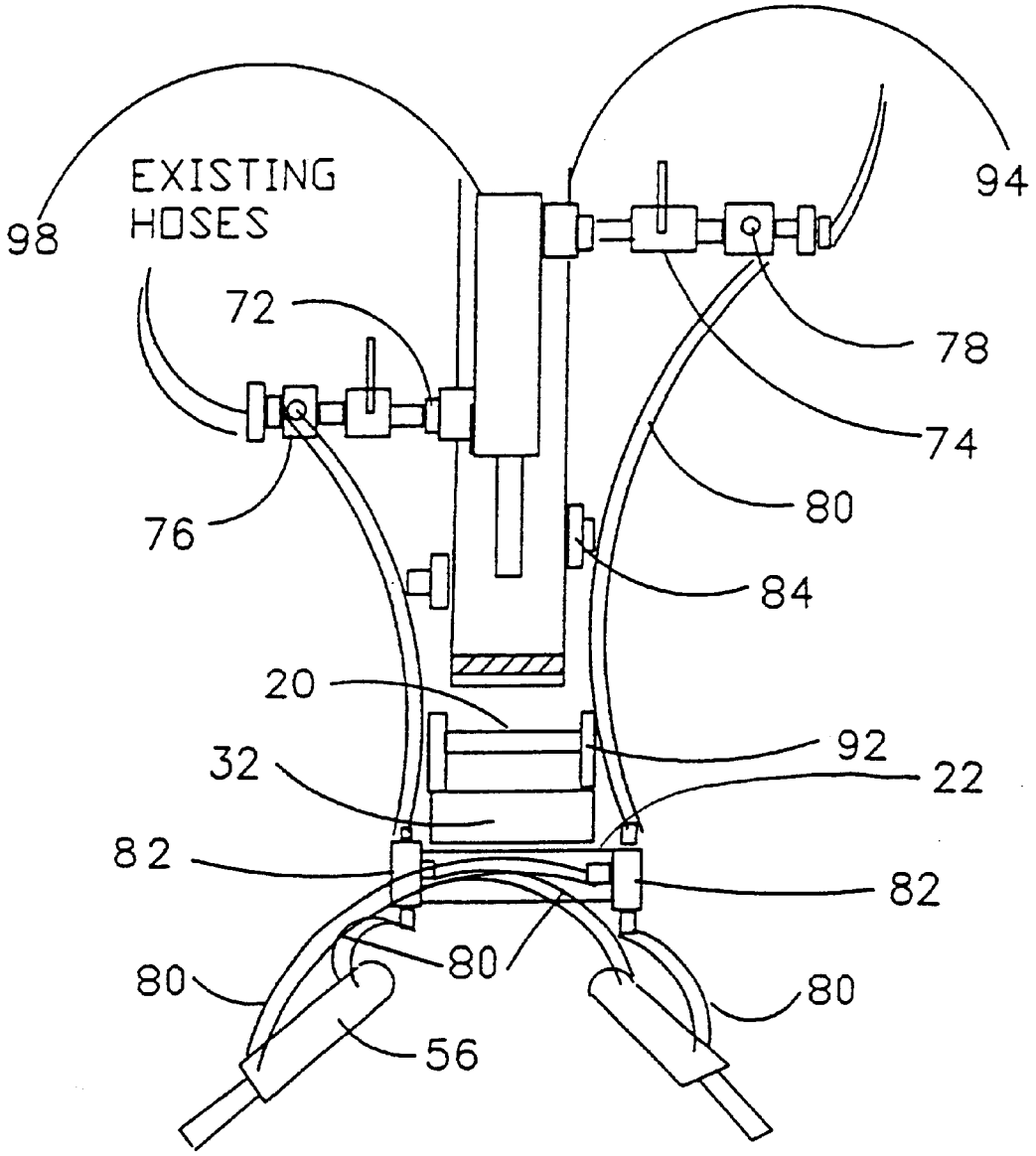
FIG. 5 shows a detailed view of the manifolds and routing of the hydraulic circuitry.

The hydraulic circuitry shown in FIG. 5 powers the bucket (70) shown in FIG. 4A and 4B. The excavator bucket cylinder hoses are removed from the excavator cylinder. Stem assembly (72) is installed in place to the ports in the excavator cylinders. The excavator bucket cylinder hoses are reconnected to valve manifolds (76). The valve (74) is closed blocking the flow of oil to the excavator cylinder. The oil is then diverted through oil ports (78), through hose assembly (80), which is held in place to the stick assembly of excavator (94) by magnetic clamp (84), to manifold tee (82) where the oil flow is divided to the ports of the two hydraulic cylinders (56). When the control valve on the host machine is moved oil flows through the existing lines to valve manifold (76) through hose assembly (80) to oil ports in hydraulic cylinder (56) moving the cylinder rods in one direction to open or close the bucket (70) shown in FIG. 4A and 4B, as desired.

Operation

Figure 6:
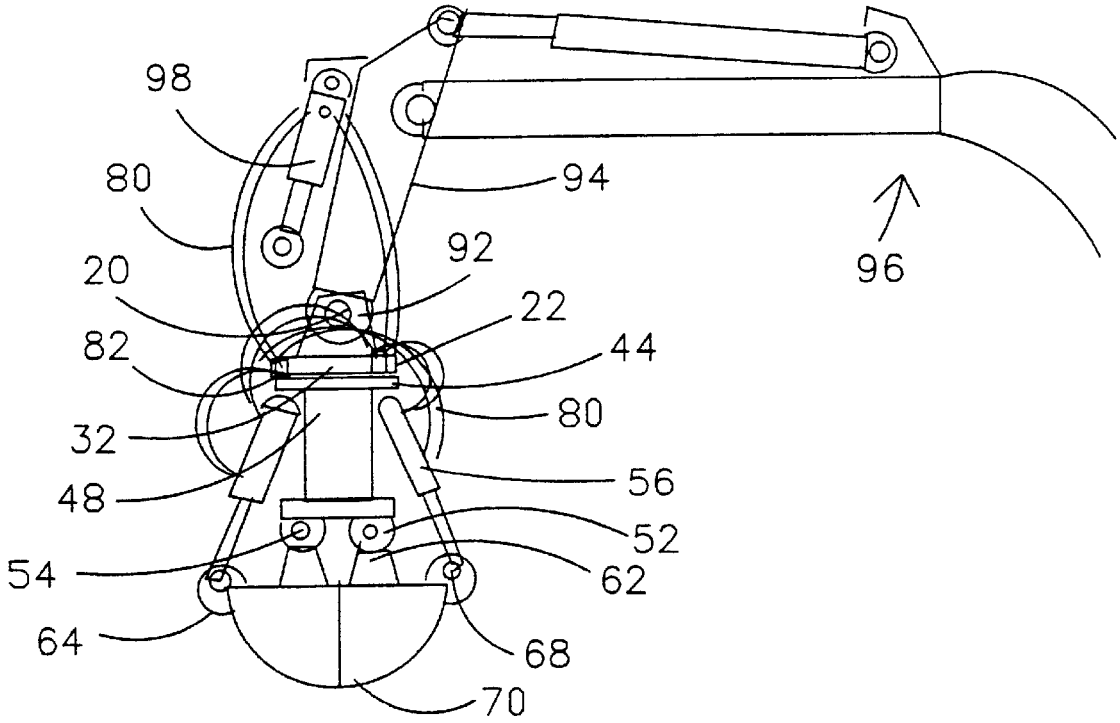
FIG. 6 shows a side view of the self-cleaning hydraulic clam bucket assembled to an excavtor including hydraulic line.

As shown in FIG. 6, the standard bucket is removed from the excavator (96), an excavator pin (20) is inserted through bores in vertical lugs (92) on rotational housing (32) and a hole in the excavator stick assembly (94) allowing the self-cleaning hydraulic clam bucket (70) to hang freely on the excavator stick assembly (94). The valve manifolds (76) are connected to the bucket cylinder of the excavator (96). Valve (74) is closed directing the oil through the hydraulic hoses (80) to the hydraulic cylinder (56). A standard control lever on the operator control panel is moved one way to open bucket (70). Reversing the lever closes the bucket (70).

The open bucket (70) is lowered to the ground and closed by the hydraulic force applied to the hydraulic cylinders (56) rod ends, causing the bucket (70) to close. Wiper plates (86) are forced to the top of the bucket (70) by the flow of material upon closing. The assembly is lifted out of the excavation and swung over the dump area. The operator reverses the control lever which in turn directs the flow of oil to the opposite ends of hydraulic cylinders (56) moving the cylinder rods inward and pulling the bucket open. Wiper plates (86) strike stops (90) forcing the wiper plates (86) downward ejecting the dirt. The bucket (70) is then swung back over the excavation and the process is repeated until the desired area is excavated.

Conclusion, Ramification, and Scope

Accordingly, the reader will see that this self-cleaning hydraulic clam bucket can be used to excavate confined areas.

- It allows for an extended depth, reaching areas previously inaccessible.
- It eliminates hand shoveling by humans, because the bucket is rotational allowing for exact placement in the excavation eliminating the need for workers in deep and dangerous excavations.
- It requires no added expense of additional hydraulic pump controls and lines to operate.
- It requires no additional training of the operator because it works off the standard controls of the machine in the same manner as the standard bucket, thus, eliminating the possibility of an accident because of an unfamiliar operation.
- The bucket is self-cleaning allowing mud or other sticky material to be removed from inside the bucket, thus no buildup of material inside the bucket, eliminating an age old problem in the industry.

Although the description above contains many specifics, these should not be construed as limiting the scope of the invention but merely providing illustrations of the presently preferred embodiments of this self-cleaning hydraulic clam bucket. For example, the bucket assembly can be used to off load barges, pick up and place rip rap on banks of levees and rivers.

Thus, the scope of the self-cleaning hydraulic clam bucket should be determined by the applied claims and their legal equivalents rather than by the examples given.

I claim:

1. A hydraulic clam bucket assembly for attachment to a stick assembly of an excavator, wherein said clam bucket assembly comprises:

- a rotational housing;
- a rotational mounting plate having pre-drilled holes;
- a square tubing extension assembly comprises a square tubing extension having a top and a bottom, and a bottom extension plate welded to the bottom of the square tubing extension, said bottom extension plate having a pair of stops, each one welded onto an opposite end of the bottom extension plate;

a clam bucket having two complementary bucket portions moveable between open and closed positions, each of said portions having a hinged wiper plate, each of said wiper plates being moveable through a 90° arc before striking one of the pair of stops on the bottom extension plate of the square tubing extension, each of said stops preventing further movement of each wiper blade as the two bucket portions open in an arc greater than 180°; and two hydraulic cylinders with manifolds and lines for opening and closing the clam bucket.

2. The clam bucket assembly of claim 1, wherein the stick assembly has an opening, and wherein the rotational housing comprises:

a circular plate having a top side, a central hole, and two spaced apart vertical lugs, each having a hole, said circular plate having been machined to accept a tapered roller bearing and a seal on the top side;

a pin, said pin being inserted through the hole in the first vertical lug;

then through the opening in the stick assembly of the excavator;

then through the hole in the second vertical lug so that said clam bucket assembly swings freely on the stick assembly of the excavator.

3. The clam bucket assembly of claim 1, wherein the rotational mounting plate comprises:

a threaded shaft welded to the rotational mounting plate wherein said rotational housing is fitted to the shaft so that the rotational mounting plate rotates freely on the bearing in the rotational housing assembly.

4. The clam bucket assembly of claim 1, wherein the square tubing extension assembly further comprises:

a top extension plate welded to the top of said square tubing extension;

said top extension plate having pre-drilled holes in a pattern that matches the pre-drilled holes in rotational mounting plate;

bolts for affixing the rotational mounting plate to said top extension plate;

two cylinder pad eyes welded directly opposite each other on the square tubing extension each cylinder pad eye having a hole for a cylinder mounting pin;

said bottom extension plate further comprising eight extension pad eyes, each having a hole for a mounting pin.

5. The clam bucket of claim 1 which further comprises:

two rolled bottom pieces;

four side plates;

four precut square tubing pieces;

four bucket assembly pad eyes, each having an opening, with replaceable bushings;

and two bucket cylinder pad eyes, each having a hole for a cylinder mounting pin;

wherein two of the four side plates and one of the said rolled bottom plates are welded together to form each of the complementary bucket portions, each portion having an inner top edge and an outer top edge.

6. The clam bucket of claim 5 which further comprises:

welding one of the square tubing pieces onto the inner top edge of each of said bucket portions;

welding one of the square tubing pieces to the outer top edge of each said bucket portions;

welding two of the four bucket assembly pad eyes onto the square tubing piece on the inner top edge of each bucket portion, one on each end;

pivotally mounting the clam bucket onto the square tubing extension by inserting pins through the holes in the corresponding pairs of bucket assembly pad eyes and extension pad eyes.

7. The clam bucket of claim 5 which further comprises:

in a central location, welding a bucket cylinder pad eye onto the square tubing piece on the outer top edge of each bucket portion;

inserting a pin through the holes in each of the corresponding pairs of bucket cylinder pad eyes and cylinder pad eyes.

8. The clam bucket of claim 1 which further comprises:

hinges welded to the square tubing piece on the inner top edge of each bucket portion, said hinges enabling said wiper plates to follow the contour of the clam bucket.

9. The hydraulic cylinders of claim 1 further comprising:

two hydraulic bucket cylinders, each having a cylinder rod and each having a first end and a second end;

two manifold assemblies;

each of said manifold assemblies comprising:

a ball valve controlling oil flow using the drilled manifold;

whereby oil is diverted at each of the bucket cylinders by closing the valve, allowing oil to travel through hoses to an end of each of said hydraulic cylinders, causing each of the cylinder rods to move in and out.

10. The hydraulic cylinders of claim 9, wherein the first end of each hydraulic cylinder attached with a pin to said square tubing extension, and the second end of each hydraulic cylinder is attached to the square tubing piece on the outer top edge of each said bucket portion; and the oil flow, as directed by an excavator operator, moves each cylinder rod in and out, causing the bucket portions to open and close.

* * * * *